US009669654B1

(12) United States Patent
Wager

(10) Patent No.: US 9,669,654 B1
(45) Date of Patent: Jun. 6, 2017

(54) APPARATUS FOR PAINTING WITH A ROLLER

(71) Applicant: PaintBTR, LLC, St. Petersburg, FL (US)

(72) Inventor: Martin Wager, St. Petersburg, FL (US)

(73) Assignee: PaintBTR, LLC, St. Petersburg, FL (US)

( * ) Notice: Subject to any disclaimer, the term of this patent is extended or adjusted under 35 U.S.C. 154(b) by 0 days.

(21) Appl. No.: 15/197,830

(22) Filed: Jun. 30, 2016

(51) Int. Cl.
*B44D 3/12* (2006.01)

(52) U.S. Cl.
CPC ..... *B44D 3/128* (2013.01)

(58) Field of Classification Search
CPC ..... B44D 3/128; B44D 3/126; B05C 17/0245
USPC ..... 206/562; 15/257.06; 220/700, 733, 220/495.02
See application file for complete search history.

(56) References Cited

U.S. PATENT DOCUMENTS

| | | | | | |
|---|---|---|---|---|---|
| 1,111,159 | A | | 9/1914 | Knox | |
| 1,813,670 | A | | 7/1931 | Kessler | |
| 1,959,584 | A | | 5/1934 | Hurley | |
| 2,471,189 | A | | 5/1949 | Bartels | |
| 2,508,947 | A | * | 5/1950 | Hoke | A47L 13/58 15/263 |
| 2,511,111 | A | | 6/1950 | Jakubowski | |
| 2,606,694 | A | | 8/1952 | Galletta | |
| 2,659,096 | A | | 11/1953 | Mencfeldowski, Jr. | |
| 2,705,334 | A | | 4/1955 | Farrow | |
| 2,849,158 | A | | 8/1958 | Hopla | |
| 3,394,425 | A | * | 7/1968 | Welt | B44D 3/126 15/257.06 |
| 3,688,943 | A | * | 9/1972 | Brown | B44D 3/123 15/257.05 |
| 3,732,593 | A | | 5/1973 | Habostad | |
| 3,940,824 | A | * | 3/1976 | Gioia | B44D 3/126 15/257.06 |
| 4,240,568 | A | | 12/1980 | Pool | |
| 4,865,282 | A | * | 9/1989 | Yonkman | B44D 3/126 15/257.06 |
| D305,819 | S | * | 1/1990 | Yonkman | D32/54 |
| 5,038,955 | A | * | 8/1991 | Studer | B44D 3/123 15/257.06 |
| 5,195,662 | A | | 3/1993 | Neff | |
| 5,546,628 | A | * | 8/1996 | Silvera | B44D 3/123 15/257.05 |
| 5,810,196 | A | * | 9/1998 | Lundy | B44D 3/128 220/23.8 |
| 6,102,235 | A | * | 8/2000 | Stern | B44D 3/126 15/257.06 |

(Continued)

FOREIGN PATENT DOCUMENTS

| | | |
|---|---|---|
| FR | 1082819 | 1/1955 |
| GB | 2460127 | 11/2009 |

*Primary Examiner* — King M Chu
(74) *Attorney, Agent, or Firm* — Larson & Larson, P.A.; Frank Liebenow

(57) ABSTRACT

A paint-bucket mesh with a roller cleaning area for filtering contaminants from a liquid coating material is disclosed including a frame having a mesh area and a roller cleaning area. A filter is held to the frame beneath the roller cleaning area by a filter. As a roller with debris thereon passes over the roller cleaning area, liquid coating material and debris fall from the roller, through openings in the roller cleaning area, and into the filter.

18 Claims, 3 Drawing Sheets

(56) References Cited

U.S. PATENT DOCUMENTS

| | | | | |
|---|---|---|---|---|
| 6,119,303 | A * | 9/2000 | Passafiume | B44D 3/128 15/257.06 |
| 6,736,969 | B2 | 5/2004 | Milne | |
| 7,137,168 | B2 * | 11/2006 | Mann | B44D 3/128 15/257.06 |
| 7,959,030 | B2 * | 6/2011 | Bergman | B44D 3/126 220/570 |
| 7,992,250 | B2 | 8/2011 | Prokop | |
| 8,281,952 | B2 | 10/2012 | Robellard | |
| 8,839,984 | B2 * | 9/2014 | Sheehy | B44D 3/123 220/700 |
| 9,145,026 | B2 | 9/2015 | Sorenson | |
| 9,168,781 | B1 | 10/2015 | Cooper | |
| 2003/0012887 | A1 | 1/2003 | Orlikowski | |
| 2004/0049876 | A1 * | 3/2004 | Bukovitz | B44D 3/128 15/257.06 |
| 2005/0039294 | A1 * | 2/2005 | Mann | B44D 3/128 15/257.06 |
| 2005/0217059 | A1 * | 10/2005 | Keane | B44D 3/121 15/257.06 |
| 2006/0000046 | A1 * | 1/2006 | Wren | B44D 3/10 15/257.06 |
| 2006/0226156 | A1 * | 10/2006 | Lundy | B44D 3/128 220/570 |
| 2010/0089931 | A1 * | 4/2010 | Sheehy | B44D 3/123 220/701 |
| 2010/0230413 | A1 * | 9/2010 | Crudgington, Jr. | B44D 3/128 220/495.02 |
| 2012/0137463 | A1 * | 6/2012 | Velazquez Arvizu | B44D 3/128 15/257.05 |
| 2014/0106078 | A1 * | 4/2014 | Childs | B44D 3/12 427/428.01 |
| 2015/0209822 | A1 | 7/2015 | Enguita | |

* cited by examiner

APPARATUS FOR PAINTING WITH A ROLLER

FIELD

This invention relates to the field of coatings and more particularly to a system for removing contaminates from a coating material when using a roller.

BACKGROUND

There are many ways to coat objects. The art of coating, often referred to as painting, uses various tools to coat surfaces including brushes, rollers, sprayers, foam brushes, etc. In general, many things are coated with various materials such as paint, varnish, polyurethane, stain, etc.

Often, it is desired to coat a surface with a smooth coating of a material such as paint. Much attention is taken to apply a smooth coat of paint or other coatings. People who apply coatings (e.g. painters), work hard to apply clean, even coats; painting in specific patterns, using high-quality brushes and rollers, etc. No matter how hard such people work at applying clean and even coats, impurities often hamper such efforts. Paint impurities come from many sources. Old paint often congeals or fragmented pieces of dried paint often find their way into the paint and onto the paint applicator. Other sources of such contamination come from the environment, dust, hair, animal hair, dirt, soil, grass, insects, etc. When such contamination mixes into the paint and winds up on the applicator (e.g., brush, roller, etc.), the contamination eventually winds up on the target that is being coated (e.g., wall). The contamination causes uneven coating on surfaces, smearing, bumps, and other marring of a quality coating.

When painting with a roller, contamination on the roller often transfers to the surface being coated or remains on the roller; causing uneven coating when the contamination contacts the surface. Applying a layer of paint on an outside wall near the grass or dirt is almost impossible, as pieces of grass or dirt almost always wind up on the roller. Once the contamination finds its way onto the roller, the contamination often remains on the roller, or is transferred to the surface being coated. The person applying the paint often uses a finger or rag to remove the contamination, piece by piece, but such is messy and time consuming.

For commercial painters, often an inspection is made by an inspector or project manager and, should any debris be found on a painted surface, the commercial painter is often required to sand to remove the debris and repaint the entire surface.

What is needed is a system that will systematically remove impurities from liquid coating material when using a paint roller.

SUMMARY

In one embodiment, a paint-bucket mesh with a roller cleaning area for filtering contaminants from a liquid coating material is disclosed including a frame having a mesh area and a roller cleaning area. A filter is held to the frame beneath the roller cleaning area by a filter. As a roller with debris thereon passes over the roller cleaning area, liquid coating material and debris fall from the roller, through openings in the roller cleaning area, and into the filter.

In another embodiment, a paint-bucket mesh with a roller cleaning area for filtering contaminants from a liquid coating material is disclosed including a frame having a mesh area and a roller cleaning area and a filter. The filter is held beneath the frame by a device for holding the filter. The filter in held an open position beneath the frame and beneath the roller cleaning area to collect debris when a roller is rolled over the roller cleaning area.

In another embodiment, a paint-bucket mesh with a roller cleaning area for filtering contaminants from a liquid coating material is disclosed including a frame having a mesh area and a roller cleaning area. A device for filtering debris from the liquid coating material is held to the frame by a device for holding the device for filtering. The device for holding holds the device for filtering in an open position beneath the frame and beneath the roller cleaning area so as to capture contaminants from a paint roller that is rolled over the cleaning area.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
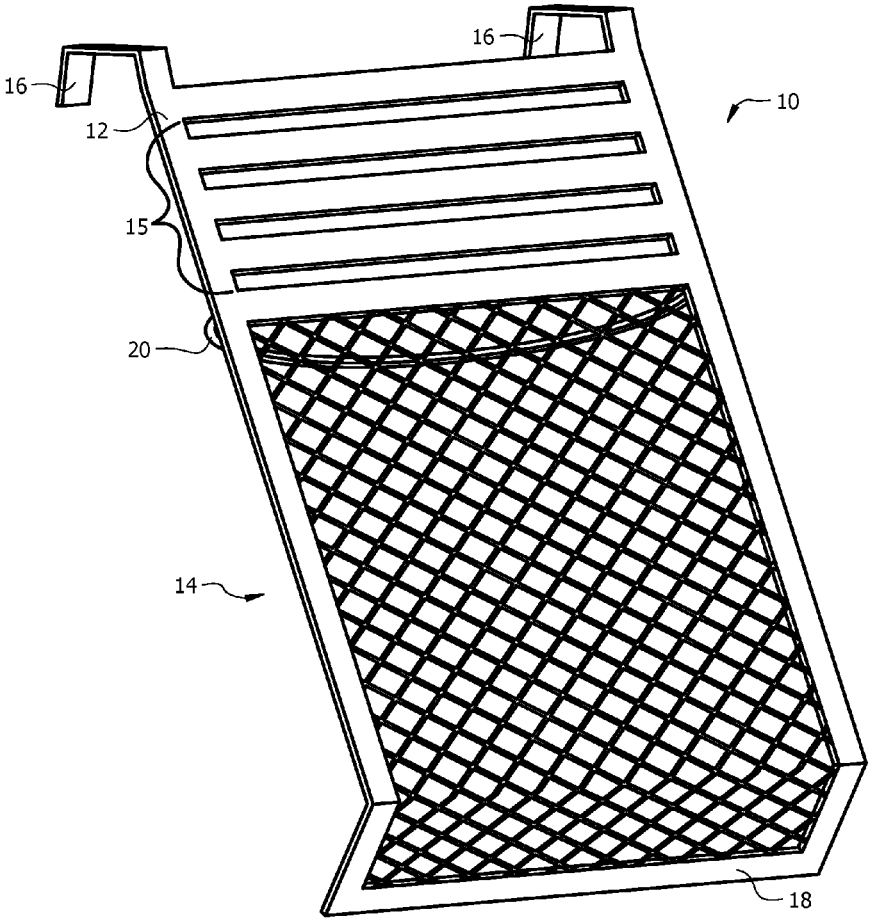
FIG. 1 illustrates a perspective view of the paint-bucket-screen with filter for filtering contaminates from a coating material.

Reference will now be made in detail to the presently preferred embodiments of the invention, examples of which are illustrated in the accompanying drawings. Throughout the following detailed description, the same reference numerals refer to the same elements in all figures.

Throughout this description, the term roller refers to a class of devices used to coat a surface with a material. Although the surface is usually a wall, there is no restriction on the surface being a wall, as ceilings, floors, and other objects are often coated using a roller. Rollers come in many shapes and sizes and configurations, all are anticipated equally.

Throughout this description, the material being used to coat the wall or other surface (coating material) is typically paint, but there is no restriction as to the material used to coat the surface, as rollers are used to coat various surfaces with materials such as stain, varnish, polyurethane, adhesives, etc.

Throughout this description, contaminants/debris is referred to. Example of such contaminants/debris include, but is not limited to dried paint fragments, hair (human or animal), insects, dirt, dust, grass clippings, sand, leaves, etc.

Figure 2:
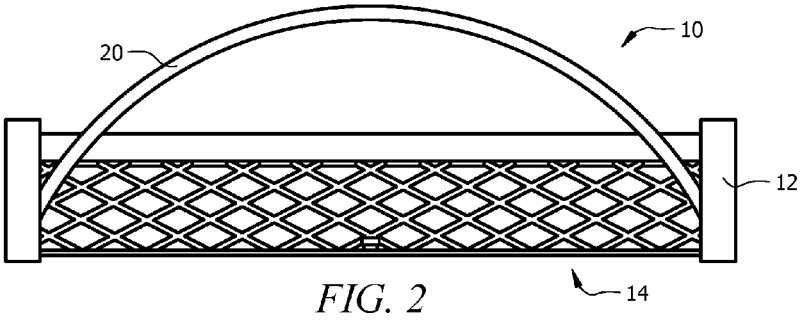
FIG. 2 illustrates an end-perspective view of the paint-bucket-screen with filter for filtering contaminates from a coating material.

Referring to FIGS. 1 and 2, perspective views of the paint-bucket-screen 10 with filter 30 for filtering contaminates from a coating material are shown from the front in FIG. 1 and from and end in FIG. 2.

Figure 5:
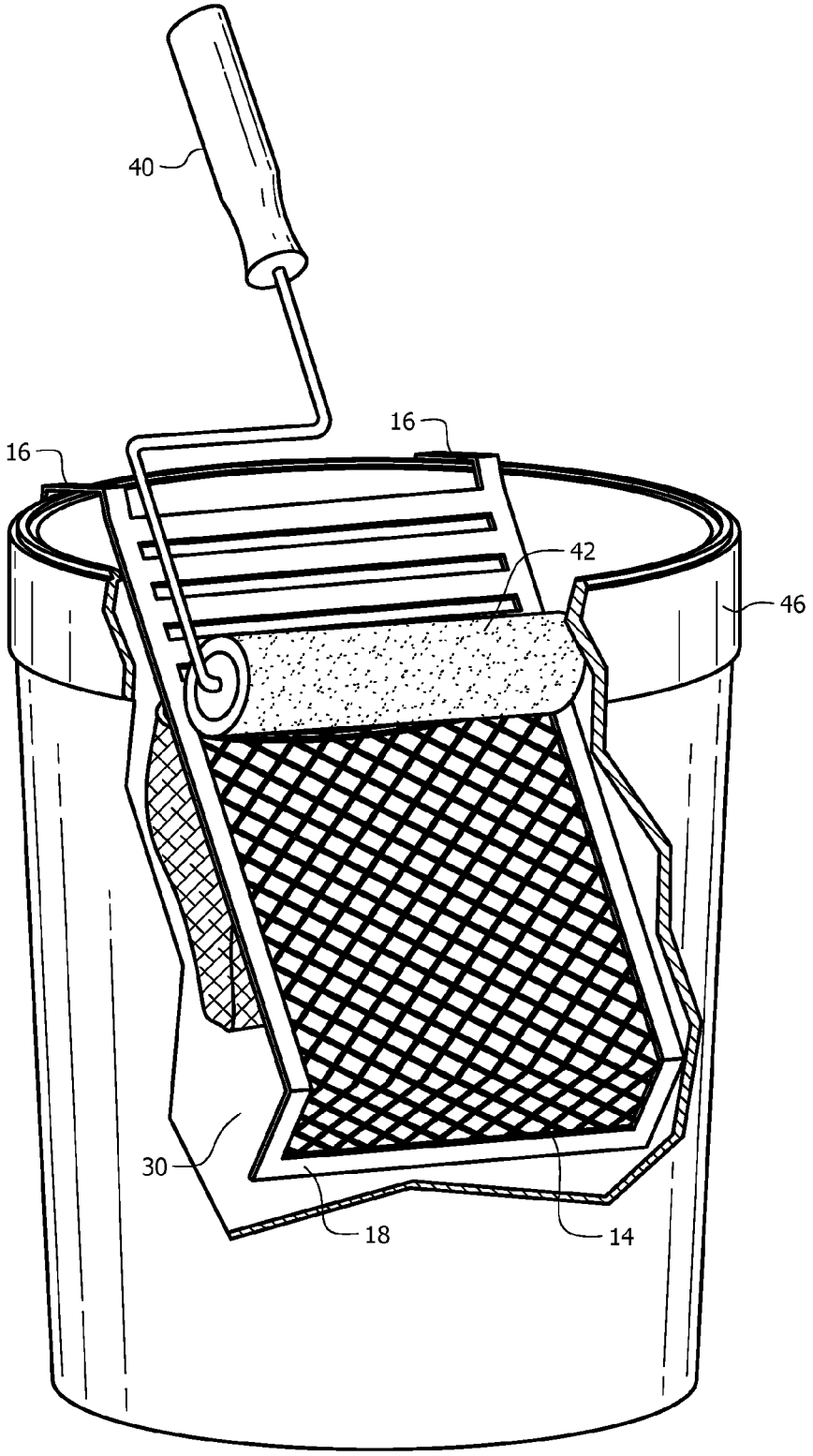
FIG. 5 illustrates a perspective view of the paint-bucket-screen with filter for filtering contaminates from a coating material in use with a roller.

The paint-bucket-screen 10 includes the mesh 14 area, a roller cleaning area 15, and frame 12/16/18 for resting within a paint bucket 46. The paint bucket 46 is typically a 5-gallon paint bucket, though any size of paint bucket 46 is anticipated. The hook portion 16 of the frame 12/16/18 is for straddling the rim of the paint bucket 46 to hold the paint-bucket-screen 10 in place as shown in FIG. 5.

The paint-bucket-screen 10 includes a filter retaining arm 20 for holding a filter 30 (see FIGS. 4 and 5) in an open mode. The filter 30 is held open beneath the roller cleaning area 15. The filter is porous so that coating material passes through the filter 30 while the contaminants (e.g. paint chips, dirt, paint globules, grass clippings, animal hair, human hair, insects, etc.) remain within the filter. Contaminates are captured in the filter 30 when a contaminated roller 42 is rolled over the roller cleaning area 15 and/or when paint is initially poured into the paint bucket 46 through the roller cleaning area 15 during filling. Although the filter retaining arm 20 is shown in the shape of an arc, other shapes are anticipated and included here within. In some embodiments, the filter retaining arm 20 folds against the frame 12/16/18 to save space when not in use and during shipping.

Figure 3:
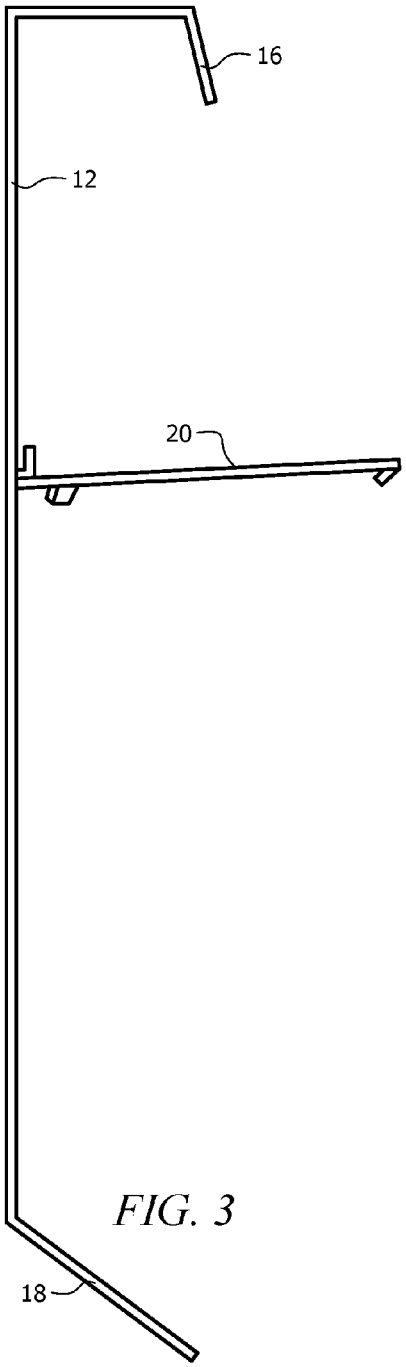
FIG. 3 illustrates a side plan view of the mesh of the paint-bucket-screen with filter for filtering contaminates from a coating material without a filter.
Figure 4:
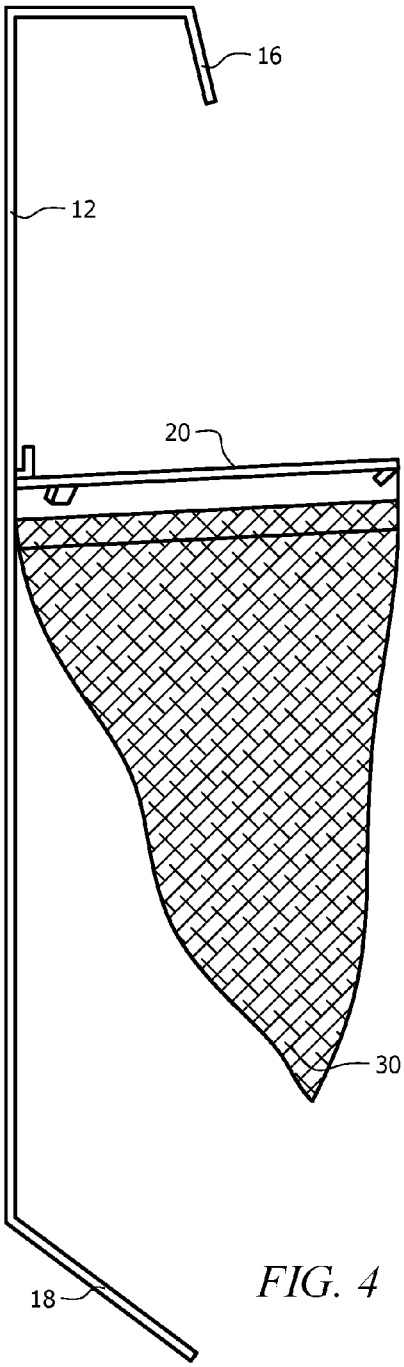
FIG. 4 illustrates a side plan view of the paint-bucket-screen with filter for filtering contaminates from a coating material with the filter.

Referring to FIGS. 3 and 4, side plan views of the paint-bucket-screen 10 with filter 30 for filtering contaminates from a coating material are shown, without a filter 30 in FIG. 3 and with a filter 30 in FIG. 4.

The paint-bucket-screen 10 includes the mesh 14, a roller cleaning area 15, and frame 12/16/18 for resting within a paint bucket 46, typically a 5-gallon paint bucket, though any size of paint bucket 46 is anticipated. The hook portion 16 of the frame 12/16/18 is for straddling the rim of the paint bucket 46 to hold the paint-bucket-screen 10 in place as shown in FIG. 5.

Prior to the disclosed paint-bucket-screen 10, any contamination in the coating material (or on the roller 42) either remained on the roller 42, flowed back into the paint bucket 46 (see FIG. 5), or were deposited on the surface being coated. In use, the roller 42 (see FIG. 5) is coated with the coating material and rolled over mesh 14 to even out the coating material over the roller 42 and to remove excess coating material from the roller 42.

To reduce such contaminants, the paint-bucket-screen 10 further includes a filter retaining arm 20 for holding a filter 30 (see FIGS. 4 and 5) in an open mode. As the roller 42 is rolled over the roller cleaning area 15, contaminants and coating material drip from the roller 42. The drips fall through the openings in the roller cleaning area 15 and fall into the filter 30. Being porous, the coating material passes through the filter 30 while the contaminants (e.g. paint chips, dirt, paint globules, grass clippings, animal hair, human hair, insects, etc.) remain within the filter 30. In this way, the coating material in the bucket 46 is not re-contaminated when the roller 42 re-wetted with the coating material.

Although the filter retaining arm 20 is shown in the shape of an arc, other shapes are anticipated and included here within. Also, any type of filter 30 is anticipated, including, but not limited to, paint filter bags, screen bags, etc.

Referring to FIG. 5, a perspective view of the paint-bucket-screen 10 with filter 30 for filtering contaminates from a coating material in use with a roller 40/42 is shown. The paint-bucket-screen 10 for filtering contaminates includes the mesh 14, the roller cleaning area 15, and the frame 12/16/18 shown resting within a paint bucket 46. The hook portion 16 of the frame 12/16/18 straddles the rim of the paint bucket 46 to hold the paint-bucket-screen 10 in place.

In use, the roller 42 is coated with the coating material; then the roller 42 is rolled over mesh 14 (held by the roller handle 40) to even out the coating material over the roller 42 and to remove excess coating material from the roller 42.

After applying the coating material to a surface using the paint roller 42, the paint roller 42 often picks up contaminants from the surface and/or surroundings. To remove the contaminates, the paint-bucket-screen 10 includes a filter retaining arm 20 for holding a filter 30 in an open position so that, as the roller 42 is rolled over the roller cleaning area 15, coating material with contaminants drips from the roller 42 and through openings in the roller cleaning area 15. The coating material and contaminants fall into the filter 30 and, being porous, the coating material passes through the filter 30 while the contaminants (e.g. paint chips, dirt, paint globules, grass clippings, animal hair, human hair, insects, etc.) remain within the filter so as not to adhere to the roller 42 when the roller 42 is re-wetted with the coating material.

Although the openings of the roller cleaning area 15 are shown as slots, any type and configuration of openings is anticipated.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A paint-bucket mesh with a roller cleaning area for filtering contaminants from a liquid coating material, the paint-bucket mesh comprising:

a frame having a mesh area and a roller cleaning area;

a filter bag; and a filter retainer for holding the filter bag in an open position beneath the roller cleaning area such that, as a roller passes over the roller cleaning area, liquid coating material and debris fall from the roller, through openings in the roller cleaning area, and into the filter bag;

wherein the filter bag is removable and replaceable.

2. The paint-bucket mesh of claim 1, wherein liquid coating material is paint.

3. The paint-bucket mesh of claim 1, wherein the paint-bucket mesh further comprises hooks at an end near the roller cleaning area.

4. The paint-bucket mesh of claim 1, wherein the hooks rest on a rim of a paint bucket.

5. The paint-bucket mesh of claim 1, wherein the filter retainer is an arc-shaped member attached to a bottom surface of the paint-bucket mesh.

6. The paint-bucket mesh of claim 1, wherein the roller cleaning area comprises horizontal slots.

7. A paint-bucket mesh with a roller cleaning area for filtering contaminants from a liquid coating material, the paint-bucket mesh comprising:

a frame having a mesh area and a roller cleaning area;

a filter bag; and means for holding the filter bag, the means for holding the filter bag holding the filter bag in an open position beneath the frame and beneath the roller cleaning area;

wherein the filter bag is removable and replaceable.

8. The paint-bucket mesh of claim 7, wherein liquid coating material is paint.

9. The paint-bucket mesh of claim 7, wherein the paint-bucket mesh further comprises hooks at and end near the roller cleaning area.

10. The paint-bucket mesh of claim 7, wherein the hooks rest on a rim of a paint bucket.

11. The paint-bucket mesh of claim 7, wherein the means for holding the filter bag is an arc-shaped member attached to a bottom surface of the paint-bucket mesh.

12. The paint-bucket mesh of claim 7, wherein the roller cleaning area comprises horizontal slots.

13. A paint-bucket mesh with a roller cleaning area for filtering contaminants from a liquid coating material, the paint-bucket mesh comprising:

a frame having a mesh area and a roller cleaning area;

means for filtering debris from the liquid coating material, the means for filtering debris comprising a flexible bag structure; and means for holding the means for filtering debris, the means for holding the means for filtering debris holds the means for filtering in an open position beneath the frame and beneath the roller cleaning area.

14. The paint-bucket mesh of claim 13, wherein the roller cleaning area comprises longitudinal slots in the frame.

15. The paint-bucket mesh of claim 13, wherein the paint-bucket mesh further comprises hooks at and end near the roller cleaning area.

16. The paint-bucket mesh of claim 7, wherein the means for holding the filter an arc-shaped member attached to a bottom surface of the paint-bucket mesh.

17. The paint-bucket mesh of claim 7, wherein the means for filtering is a filter bag.

18. The paint-bucket mesh of claim 7, wherein the means for filtering is removable and replaceable.

* * * * *